US007392931B2

(12) United States Patent
Issler

(10) Patent No.: US 7,392,931 B2
(45) Date of Patent: Jul. 1, 2008

(54) SHOE BOX

(75) Inventor: Kristin Issler, Nashua, NH (US)

(73) Assignee: Columbia Insurance Company, Omaha, NE (US)

( * ) Notice: Subject to any disclaimer, the term of this patent is extended or adjusted under 35 U.S.C. 154(b) by 155 days.

(21) Appl. No.: 10/987,544

(22) Filed: Nov. 12, 2004

(65) Prior Publication Data

US 2006/0102707 A1 May 18, 2006

(51) Int. Cl.
*B65D 43/16* (2006.01)

(52) U.S. Cl. ..... 229/145; 229/125.08; 229/125.19; 229/154

(58) Field of Classification Search ..... 229/125.08, 229/125.11, 125.19, 141, 145, 152, 153, 229/154

See application file for complete search history.

(56) References Cited

U.S. PATENT DOCUMENTS

| | | | | | |
|---|---|---|---|---|---|
| 1,859,903 | A | * | 5/1932 | Wellman | 229/125.08 |
| 3,019,959 | A | * | 2/1962 | Skowronski | 229/145 |
| 3,292,841 | A | * | 12/1966 | Donovan | 229/125.19 |
| 3,640,449 | A | * | 2/1972 | Bastian | 229/154 |
| 3,967,774 | A | * | 7/1976 | Querner | 229/125.19 |
| 4,008,807 | A | | 2/1977 | Phillips | 211/34 |
| 4,284,193 | A | * | 8/1981 | Roccaforte | 229/151 |
| 4,819,795 | A | | 4/1989 | Swaney | 206/278 |
| 5,105,950 | A | * | 4/1992 | Gottfreid et al. | 229/125.19 |
| 5,105,971 | A | * | 4/1992 | Hertenstein et al. | 229/152 |
| D332,184 | S | | 1/1993 | Becker | D6/397 |
| 5,398,868 | A | * | 3/1995 | Densen | 229/125.08 |
| 5,590,766 | A | | 1/1997 | Carnahan et al. | 206/296 |
| 5,940,935 | A | * | 8/1999 | Julius | 229/125.11 |
| D429,085 | S | | 8/2000 | Welty et al. | D6/397 |
| 6,213,298 | B1 | | 4/2001 | Nguyen | 206/459 |
| 6,305,533 | B1 | | 10/2001 | Welty et al. | 206/278 |
| 2002/0092787 | A1 | | 7/2002 | Cheng | 206/459.5 |

* cited by examiner

*Primary Examiner*—Gary E Elkins
(74) *Attorney, Agent, or Firm*—St. Onge Steward Johnston & Reens LLC

(57) ABSTRACT

The invention relates to a box that has a front wall, a right wall, a left wall, a rear wall, and a bottom in contact with the front, right, left, and rear walls for defining an open-top container. A corresponding lid is also included and where the lid extends from the right wall to the left wall and from the front wall to the rear wall for covering the opening top container. The lid is hingedly attached to the rear wall for opening and closing the box and a detaching mechanism is placed between the lid and rear wall for detaching the lid from the rear wall.

6 Claims, 4 Drawing Sheets

SHOE BOX

FIELD OF THE INVENTION

The invention relates to improved packaging for an article and, more particularly, packaging that has an attached cover for inhibiting misplacement and that permits detachment of the attached cover for displaying the article inside.

BACKGROUND OF THE INVENTION

Traditionally, packaging for an article, such as a pair of shoes, may have included a box for shipping, storing, and displaying the article. The box often consisted of a four sided cardboard structure with a bottom that connected the four sided structure and a cover that enclosed an article placed within the four sided structure. However, often times when the traditional box is used for shipping from the factory to a warehouse and ultimately to a retail store, the box may become damaged at some point along the way. Additionally, when the box is stored at a point during the transfer from factory to display at the retail store, or at the retail store prior to being displayed or sold, the box may be subjected to compressive forces. This usually occurs when a vertical column of many boxes are placed on top of one another and the bottom box normally bears the brunt of the total weight of the column of boxes. Such vertical column stacking is a frequently adopted manner for storing boxes among many retailers and perhaps warehouses as well.

As a possible result, some boxes may become damaged to the point they are no longer suitable for display at the retail store. In certain cases, the articles within the boxes may also become damaged. Damage to boxes may be exacerbated by the constant handling of the boxes due to purchasers' requirements to try on a selection of sizes and styles before buying, which often causes a worker to retrieve and restack numerous boxes of shoes. In the event a box in a lower portion of the vertical stack is desired, the worker may pull upon the box's cover to extract the box from the stack, which can result in the cover becoming torn.

Another disadvantage of traditionally provided boxes is that, during the transfer between factory and retail store or during the constant handling of the boxes, the cover may become separated from the bottom of the box and lost.

In addition to the possibility of the boxes being damaged or the covers being lost, a further disadvantage is that the articles within the damaged boxes, even if the articles are not damaged themselves, may not be salable because stores often require purchasers who return shoes to return the box in a resale condition.

What is desired, therefore, is a box that is resistant to damage due to constant handling. Another desire is a box that inhibits separation of the cover from the bottom of the box. A further desire is a box that is stronger than conventionally provided boxes for withstanding compressive forces.

SUMMARY OF THE INVENTION

It is, therefore, an object of the invention to provide a box that is stronger than traditional boxes.

It is another object to provide a box that includes a lid that resists breakage.

It is a further object to provide a box with a lid that is difficult to misplace or separate from its corresponding open-top container.

Yet another object is to provide a box that may be presented for display along with the contents of the box.

These and other objects of the invention are provided by a box that has a front wall, a right wall, a left wall, a rear wall, and a bottom in contact with the front, right, left, and rear walls for defining an open-top container. A corresponding lid is also included and where the lid extends from the right wall to the left wall and from the front wall to the rear wall for covering the opening top container. The lid is hingedly attached to the rear wall for opening and closing the box and a detaching mechanism is placed between the lid and rear wall for detaching the lid from the rear wall.

The detaching mechanism may be a string that, when pulled by a user, detaches the lid from the rear side wall.

The lid further includes a fore wall, port wall, and starboard wall. In some embodiments, the lid also has an aft wall, where the aft wall is a flap. The flap may have a tab that, when the lid is connected to the open-top container, is inserted into a closing hole to secure the flap in a closed position and, when the lid is detached from the open-top container, is inserted into an opening hole to secure the flap in an open position. Optionally, the box includes a handle attached to either the left or right wall for users to manipulate to position the box.

In another aspect, the box includes a lid having a planar portion extending from the right wall to the left wall and from the front wall to the rear wall for covering the opening top container. The lid also has an aft wall, a fore wall, a port wall, and a starboard wall. The box further has a detaching mechanism placed between the aft wall and the rear wall for detaching the lid from the rear wall, wherein the lid is hingedly attached to the rear wall for opening and closing the box.

In another aspect of the invention, a method for providing a box is provided to include the steps of providing a front wall, right wall, left wall, rear wall, and bottom, where the method further contacts the bottom with the front, right, left, and rear walls for defining an open-top container. The method also includes extending a lid from the right wall to the left wall and from the front wall to the rear wall for covering the opening top container, hingedly attaching the lid to the rear wall for opening and closing the box, and placing a detaching mechanism between the lid and the rear wall for detaching the lid from the rear wall.

Optionally, the method may include the step of providing a lid having a fore wall, port wall, starboard wall, and flap. In some embodiments, the method includes the step of placing the detaching mechanism between the flap of the lid and the rear wall for detaching the lid from the rear wall. Further, the method may optionally include the step of extending a tab from the flap and wherein placing the tab in a closing hole secures the flap in a closed position and wherein placing the tab in an opening hole secures the flap in an open position.

To facilitate handling the box, the method may optionally include the step of providing a handle attached to the right wall.

DETAILED DESCRIPTION OF THE DRAWINGS

Figure 1:
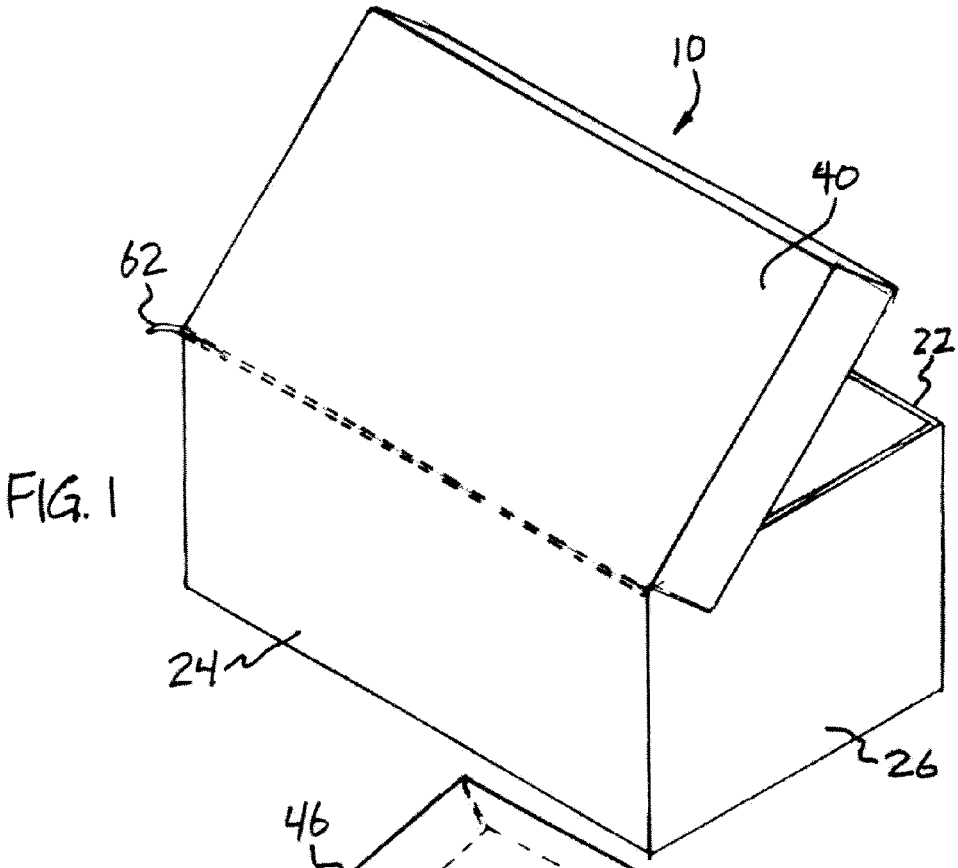
FIG. 1 depicts the box in accordance with the invention.

FIG. 1 depicts box 10 in accordance with the invention. Box 10 includes front wall 22, rear wall 24, right wall 26, left wall 28, and bottom 30 in contact with all of the above walls for defining an open-top container.

Box 10 also includes lid 40, which extends from right wall 26 to left wall 28 and from front wall 22 to rear wall 24 for covering the open-top container. Lid 40 is hingedly attached to rear wall 24 so that lid 40 may open and close the open-top container with a lesser likelihood of being misplaced since lid 40 is attached to rear wall 24.

Box also includes detaching mechanism 62 placed between lid 40 and rear wall 24 for detaching lid 40 from rear wall 24, which effectively separates lid 40 from the open-top container. Actuating detaching mechanism 62 transforms box 10 from a one piece unit into a two piece shoe box. The two piece shoe box may, when lid 40 is removed, be used to display the article within box 10.

As shown, detaching mechanism 62 is a draw string placed on an inner wall of rear wall 24 and protruding out proximately between rear wall 24 and either left wall 28 or right wall 26 so that a user may pull upon this protruding part of detaching mechanism 62 to tear through a junction of rear wall 24 and lid 40 to separate lid 40.

Figure 2:
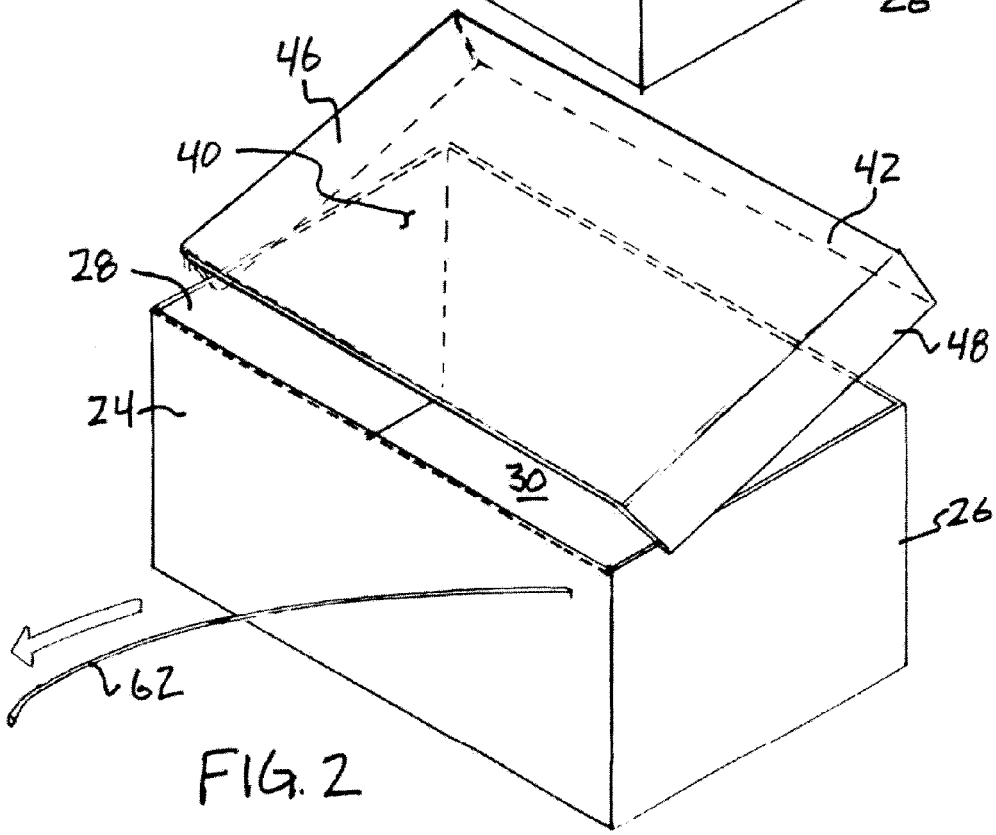
FIG. 2 depicts the lid being attached from the rear wall of the box shown in FIG. 1.

As shown, detaching mechanism 62 follows a junction between lid 40 and rear wall 24 such that, upon actuation, detaching mechanism 62 separates lid 40 and results in the open-top container shown in FIG. 2.

As shown in FIGS. 1 and 2, lid 40 includes fore wall 42, port wall 46, and starboard wall 48 to conform lid 40 to emulate a more conventionally appearing lid.

Figure 6:
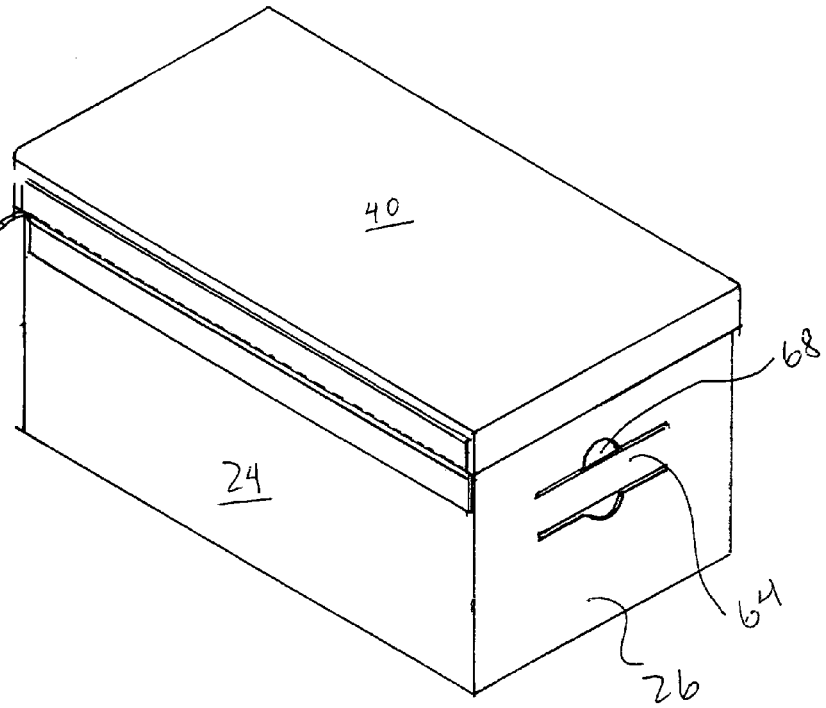
FIGS. 6-8 more particularly show the rear wall of the lid of FIG. 1 being detached from the rest of the box.

Optionally, as shown in FIG. 6, handle 64 may be provided on either right wall 26 or left wall 28, or both, so that a user may pull upon box 10, particularly when box 10 is beneath a number of other boxes stacked on top of box 10, with a lesser likelihood of damaging box 10 due to the act of pulling. Handle 64 may be material added to the side of box 10 or it may be material cut from a side of box 10, as shown in FIG. 6. Aperture 68 resulting from handle 64 being cut from a side of the box may further provide ventilation of moisture or air from within box 10.

Figure 3:
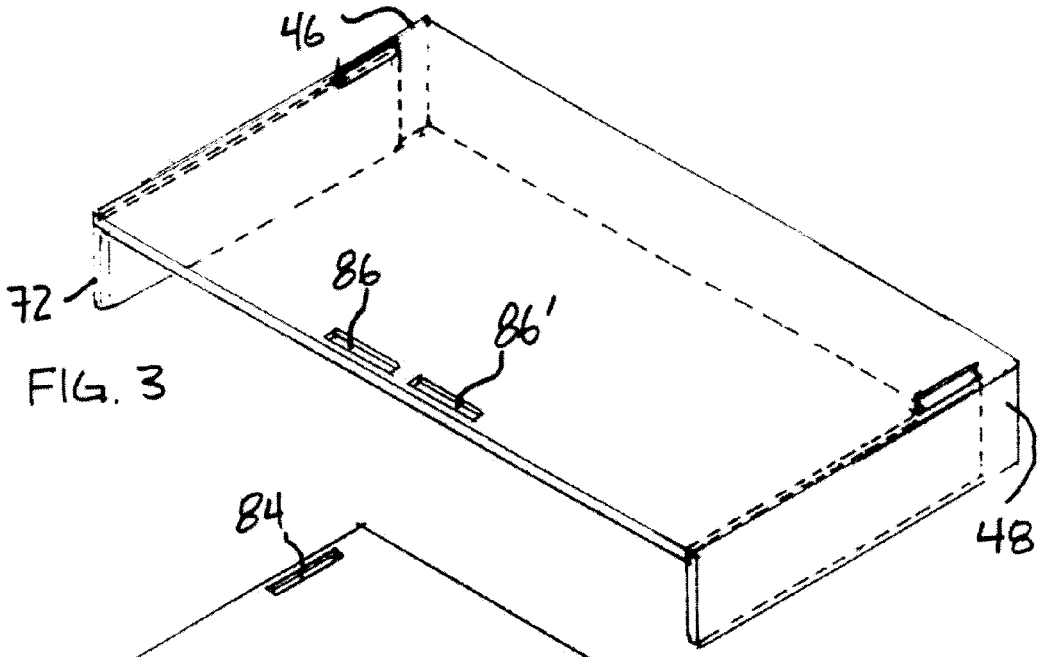
FIGS. 3-5 more particularly show the lid of FIG. 1 where flaps unfold to form a rear wall of the lid.
Figure 4:
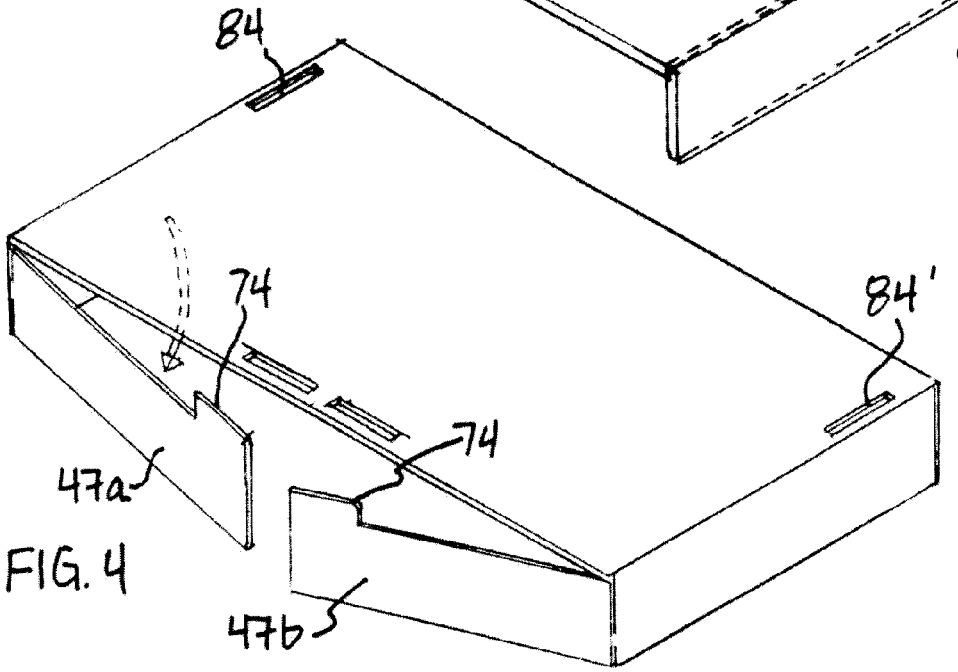
Figure 5:
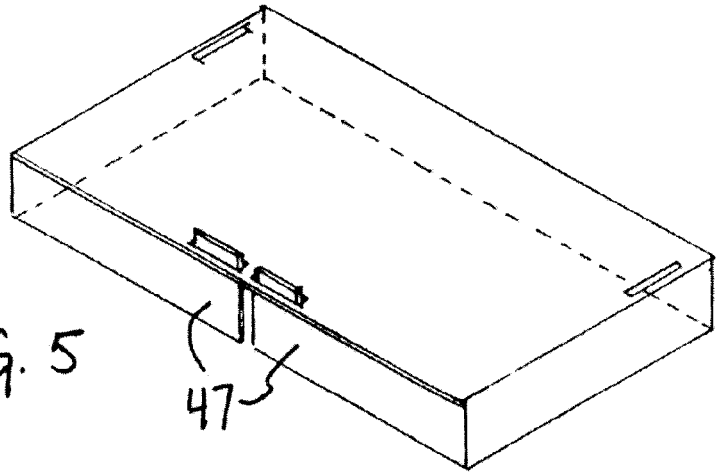

As shown in FIGS. 3-5, lid 40 may include aft wall 47, which are two foldable flaps that are secured to lid port wall 46 and starboard wall 48.

In reference to FIGS. 3 to 5, and after separation of lid 40 from rear wall 24, first flap 47*a* is unfolded about fold line 72 from its closed position, where first tab 74 is placed within closing hole 84, to its open position, where first tab is inserted into opening hole 86. Second flap 47*b* functions the same way as first flap 47*a* with respect to closing hole 84', opening hole 86', and first tab 74'.

First tabs 74, 74' extend from wall 47*a*, 47*b* an arbitrary distance away but should be long enough so that it should not slip out from holes 84, 86, 84', 86'.

Figure 7:
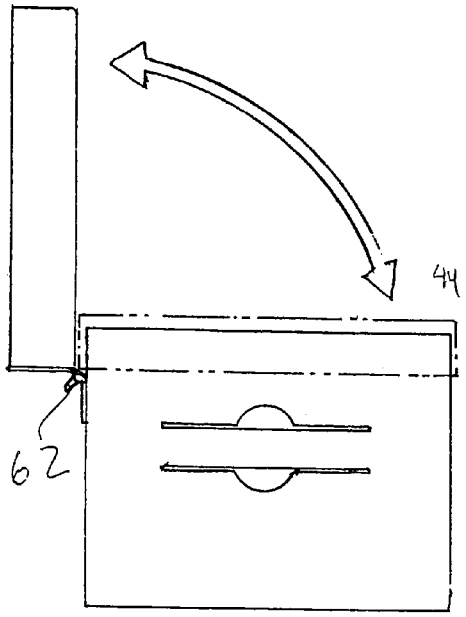
Figure 8:
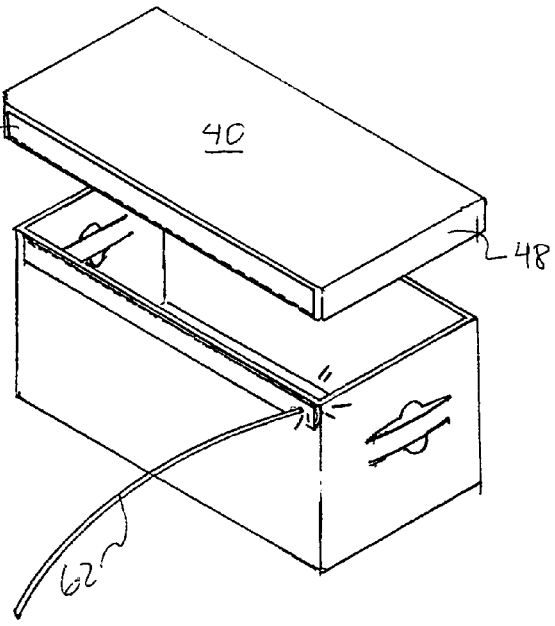

In another embodiment of lid 40, shown in FIGS. 6-8, lid 40 includes fore wall 42, port wall 46, starboard wall 48, and aft wall 47 all of which are connected to lid 40. The sides of fore wall 42 and aft wall 47 are connected to the sides of port wall 46 and starboard wall 48. The sides of port wall 46 and starboard wall 48 are connected to the sides of fore wall 42 and aft wall 47.

Furthermore, detaching mechanism 62 is placed between aft wall 47 and rear wall 24 for separating lid 40 from the open-top container. In this embodiment, lid 40 more closely represents a traditionally appearing lid when separated from the open-top container.

It is understood that although the box is described above as being used for a shoe, the invention is not limited to packaging shoes but may be used for all articles that may be packaged in a box, such as articles that are to be shipped, moved, or displayed. Box 10 may be used to ship, move, or display large articles, such as a bicycle, computer, or dinnerware. Box may also be used to ship, move, or display enormous articles, such as a stove or refrigerator.

Figure 9:
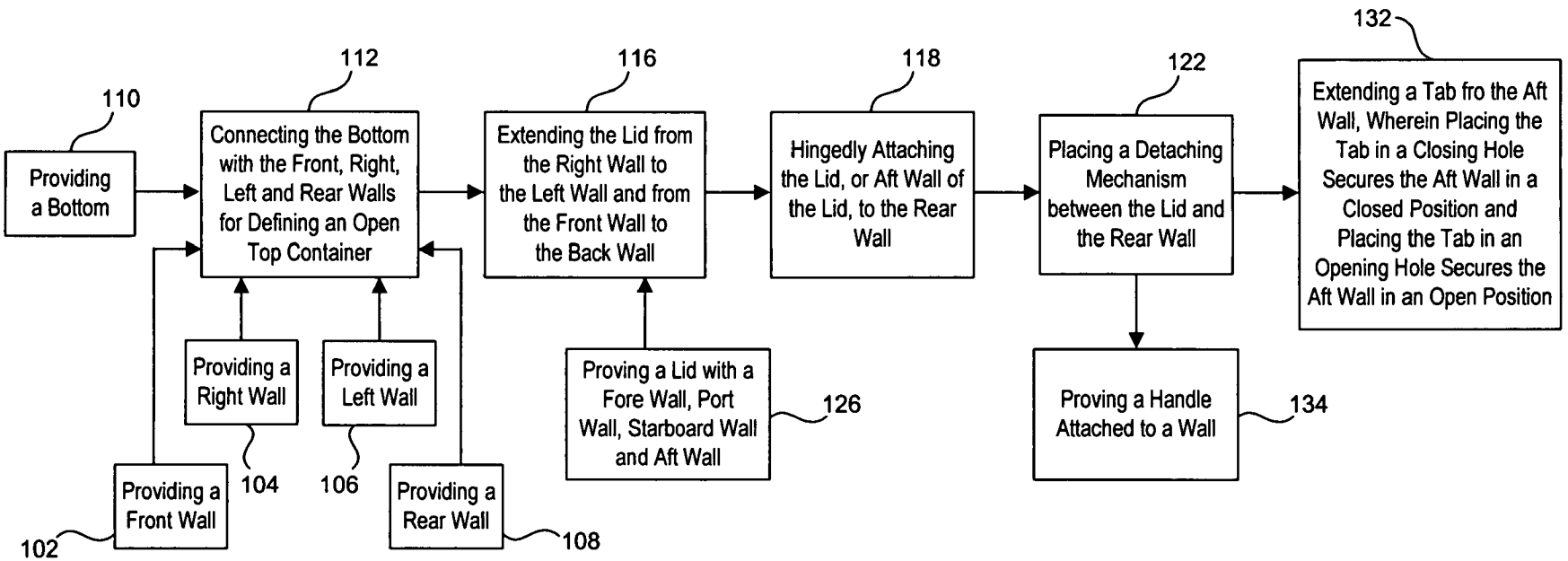
FIG. 9 depicts a method of providing the box shown in FIG. 1.

FIG. 9 depicts method 100 for providing the box described above. Method 100 includes the steps of providing 102 a front wall, providing 104 a right wall, providing 106 a left wall, providing 108 a rear wall, providing 110 a bottom, and contacting 112 the bottom with the front, right, left, and rear walls for defining an open-top container having 4 sides and a bottom but no top.

Method 100 also includes extending 116 a lid from the right wall to the left wall and from the front wall to the rear wall for covering the open top container described above. Method 100 further includes hingedly attaching 118 the lid to the rear wall for opening and closing the open top container and placing 122 a detaching mechanism between the lid and the rear wall for permitting detachment of the lid from the rear wall.

To define a lid with more structural integrity, method 100 may optionally include the step of providing 126 a lid having a fore wall, port wall, starboard wall, and flap, wherein method 100 places 128 the detaching mechanism between the flap of the lid and the rear wall for permitting detachment the lid from the rear wall.

Optionally, in some embodiments, method 100 may also include extending 132 a tab from the flap, wherein placing the tab in a closing hole secures the flap in a closed position and wherein placing the tab in an opening hole secures the flap in an open position.

Method 100 may also include the step of providing 134 a handle attached to a wall, such as the left, right, front, or rear wall.

What is claimed is:

1. A box, comprising:

a front wall;

a right wall;

a left wall;

a rear wall;

a bottom in contact with said front, right, left, and rear walls for defining an open-top container;

a lid extending from said right wall to said left wall and from said front wall to said rear wall for covering said opening top container;

said lid is hingedly attached to said rear wall for opening and closing the box; a detaching mechanism placed between said lid and said rear wall for detaching said lid from said rear wall;

said lid further includes a fore wall, port wall, starboard wall, and an aft wall; and wherein said aft wall includes a tab, said tab is placed in a closing hole in said lid to secure a flap in a closed position and said tab is placed in an opening hole in said lid to secure said flap in an open position.

2. The box according to claim 1, wherein said detaching mechanism is a string that, when pulled by a user, detaches said lid from a rear side wall.

3. A method for providing a box, comprising the steps of:

providing a front wall;

providing a right wall;

providing a left wall;

providing a rear wall;

providing a bottom in contact with the front, right, left, and rear walls for defining an open-top container;

extending a lid from the right wall to the left wall and from the front wall to the rear wall for covering the open top container;

hingedly attaching the lid to the rear wall for opening and closing the box.

placing a detaching mechanism between the lid and the rear wall for detaching the lid from the rear wall;

extending a fore wall, port wall starboard wall, and flap from the lid; and forming a tab on the flap and wherein placing the tab in a closing hole secures the flap in a closed position and wherein placing the tab in an opening hole secures the flap in an open position.

4. A box, comprising:

a front wall;

a right wall;

a left wall;

a rear wall;

a bottom in contact with said front, right, left, and rear walls for defining an open-top container;

a lid including an aft wall and being removably attached to said rear wall; and said aft wall includes at least one flap and where, after said lid is removed from said rear wall, said at least one flap includes a tab for placement in a closing hole in said lid for securing said at least one flap in a closed position or in an opening hole in said lid for securing said at least one flap in an open position.

5. The box according to claim 4, wherein said lid is hingedly attached to said rear wall for opening and closing the box.

6. The box according to claim 4, wherein a detaching mechanism placed between said lid and said rear wall for detaching said lid from said rear wall.

* * * * *